US005425566A

United States Patent [19]

Buchacz

[11] Patent Number: 5,425,566

[45] Date of Patent: Jun. 20, 1995

[54] WORKING CHAIR

[76] Inventor: Jurek Buchacz, Lovli, N-2360 Ringsaker, Norway

[21] Appl. No.: 984,413

[22] PCT Filed: Sep. 4, 1991

[86] PCT No.: PCT/NO91/00115

§ 371 Date: Jul. 12, 1993

§ 102(e) Date: Jul. 12, 1993

[87] PCT Pub. No.: WO92/03951

PCT Pub. Date: Mar. 19, 1992

[30] Foreign Application Priority Data

Sep. 5, 1990 [NO] Norway ..... 903878

[51] Int. Cl.[6] ..... A47C 1/032

[52] U.S. Cl. ..... 297/301; 297/302; 297/320; 297/353

[58] Field of Search ..... 297/300–302, 297/306, 313, 320, 353

[56] References Cited

U.S. PATENT DOCUMENTS

| | | | |
|---|---|---|---|
| 3,989,297 | 11/1976 | Kerstholt | 297/306 X |
| 4,198,094 | 4/1980 | Bjerknes et al. | 297/306 |
| 4,575,150 | 3/1986 | Smith | 297/300 |
| 4,763,950 | 8/1988 | Tobler | 297/301 |

FOREIGN PATENT DOCUMENTS

| | | | |
|---|---|---|---|
| 105955 | 4/1984 | European Pat. Off. | 297/301 |
| 2255076 | 11/1972 | Germany . | |
| 2903251 | 12/1980 | Germany . | |
| 3616475C1 | 6/1987 | Germany . | |
| 3640336 | 6/1987 | Germany | 297/301 |
| 166213 | 3/1991 | Norway . | |
| 638964 | 10/1983 | Switzerland . | |
| WO89/06101 | 7/1989 | WIPO . | |

*Primary Examiner*—Peter R. Brown
*Attorney, Agent, or Firm*—Tilton Fallon Lungmus

[57] ABSTRACT

A chair, especially a working/office chair, comprising a seat-supporting frame (3), a seat (1) rotatably mounted in the frame (3) about a first axis (2), a back support (6) rotatably mounted in the frame (3) about a second axis (7) behind the first one, and a coupling device (20) connected between the seat (1) and the back support (6) behind said axes to cause a synchronous movement of the seat (1) in relation to the back support (6). the coupling device (20) consists of a member having a length which can be readjusted with a certain inertia for adjustment of the relative position of the seat (1) and the back support (6), so that the position of the seat (1) in relation to the back (4) can be readjusted by the exertion of a torque on the seat (1) while the back support (6) simultaneously is kept essentially stationary in relation to the frame (3).

5 Claims, 3 Drawing Sheets

WORKING CHAIR

The present invention relates to a chair, especially a working/office chair, comprising a seat-supporting frame, a seat rotatably mounted in the frame about a first axis, a back support pivotally mounted in the frame about a second axis behind the first one, and a coupling means connected between the seat and the back support behind said axes to cause a synchronous movement of the seat in relation to the back support.

A chair of the above-mentioned type is, for example, known from U.S. patent specification No. 4,143,910.

There are previously known many different types of adjustable chairs based on different principles with respect to "sitting technique". With the pure tilting chair, wherein the seat and back are formed in one piece, the chair can be regulated backwards without the person sitting in the chair having the possibility to vary the "body angle", i.e. the angle between the thighs and the upper part of the body. An opening of the "body angle" is favourable, i.a. with a view to a better blood circulation.

In the type of chair having an angularly adjustable back and a fixed seat, one achieves the advantage that the body angle can be opened in a position of rest. The drawback of a fixed seat is, however, that the body tends to slide forwards (and off the chair) in the position of rest.

In a chair of the type stated in the introduction, i.e. a chair having a synchronous adjustment of the seat and back, one achieves the advantage that the body angle can be opened in the position of rest, at the same time as the seat is readjusted synchronously backwards in a certain ratio (e.g. 1:2) to the back. This prevents that one slides off the chair when the back is tilted backwards.

As stated in the introduction, a chair of this type includes separate axes of rotation for the seat and back, and the coupling means between the seat and the back may consist of a link arm or a linkage. Springs for the return of seat and back are disposed in the axis of rotation of these members, or at another suitable location dependent on the type of spring which is used.

An important function, especially in working or office chairs, is the seat angle adjustment forwards. This is particularly important in connection with larger height adjustment ranges. In a traditional chair having a synchronous adjustment, a seat adjustment forwards will cause a too large angular change of the back of the chair forwards (in the ratio 2:1 or more). It is possible to provide an extra adjustment (double seat) having a separate adjustment between the seat and the seat member of the mechanism. However, this would be a complicated solution, and in addition cumbersome to the user which all the time would have to operate an additional handle.

It is an object of the invention to provide a chair of the type in question with which one achieves a synchronous adjustment of the seat and back backwards and a separate angular adjustment of the seat forwards without having to operate a handle.

The above-mentioned object is achieved with a chair of the introductorily stated type which, according to the invention, is characterized in that the coupling means consists of a means having a length which can be readjusted with a certain inertia for adjustment of the relative position of the seat and the back support, so that the position of the seat in relation to the back can be readjusted by the exertion of a torque on the seat while the back support simultaneously is kept essentially stationary in relation to the frame.

In a preferred embodiment the coupling means consists of a hydraulic cylinder.

In the chair according to the invention the seat and the back can be adjusted in accordance with the desired body posture in a particularly simple and user-friendly manner, the user not being in need of operating adjustment knobs or handles, and the structural solution being suitable for small as well as large chair sizes. The position of the seat in relation to the back can be readjusted in that the user in a sitting position only holds on to the seat and exerts a suitable turning moment or torque thereon about the axis of rotation of the seat, so that the coupling means is lengthened or shortened as desired. However, because of the inertia of the coupling means, its length will persist substantially constant for the normal tilting movement of the chair, so that the seat and back then move in the dimensionally conditioned synchronous ratio.

The invention will be further described below in connection with an exemplary embodiment with reference to the drawings, wherein FIG. 1 shows a schematic side view of a chair according to the invention;

Figure 1:
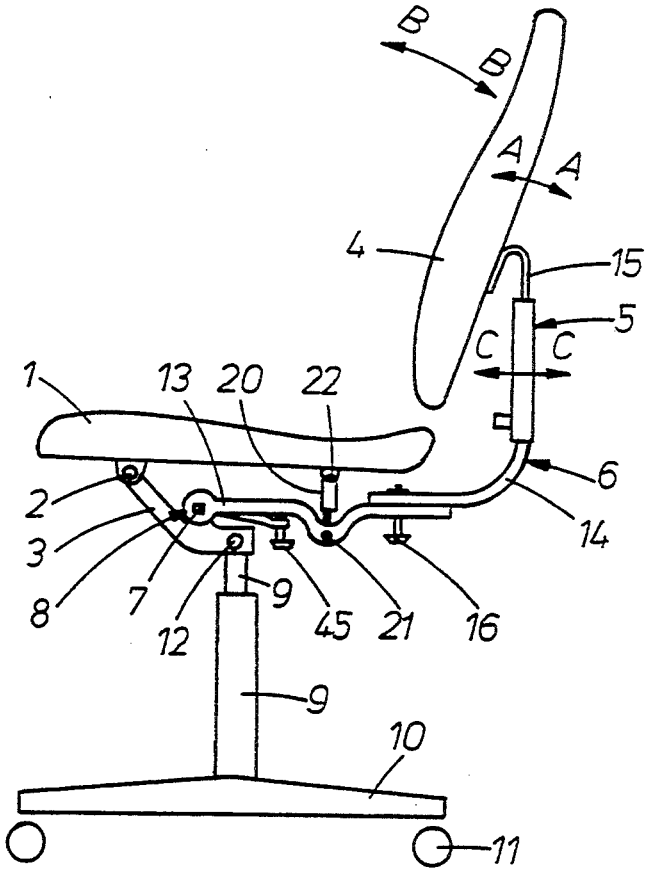

As appears from FIG. 1, the illustrated chair comprises a seat 1 which is rotatably mounted about a first axis 2 in a seat-supporting frame or bracket 3, and a back 4 which, by means of an adjustable holding means 5, is attached to a back support 6 which in turn is rotatably mounted in the frame about a further axis 7. The axis 7 is located in a mechanism 8 comprising a torsion spring shown more in detail in FIG. 2.

The frame or bracket 3 is supported by a conventional gas cylinder 9 for height adjustment of the seat 1. The gas cylinder 9 is fixed in a hole in the mechanism 8 by means of the cone principle. Further, the gas cylinder at its lower end is fixed in a chair cross 10 of a usual type comprising five casters (only two shown) 11. Height adjustment for obtaining a desired sitting height is obtained by releasing the gas cylinder in a known manner by means of a lever 12.

Figure 3:
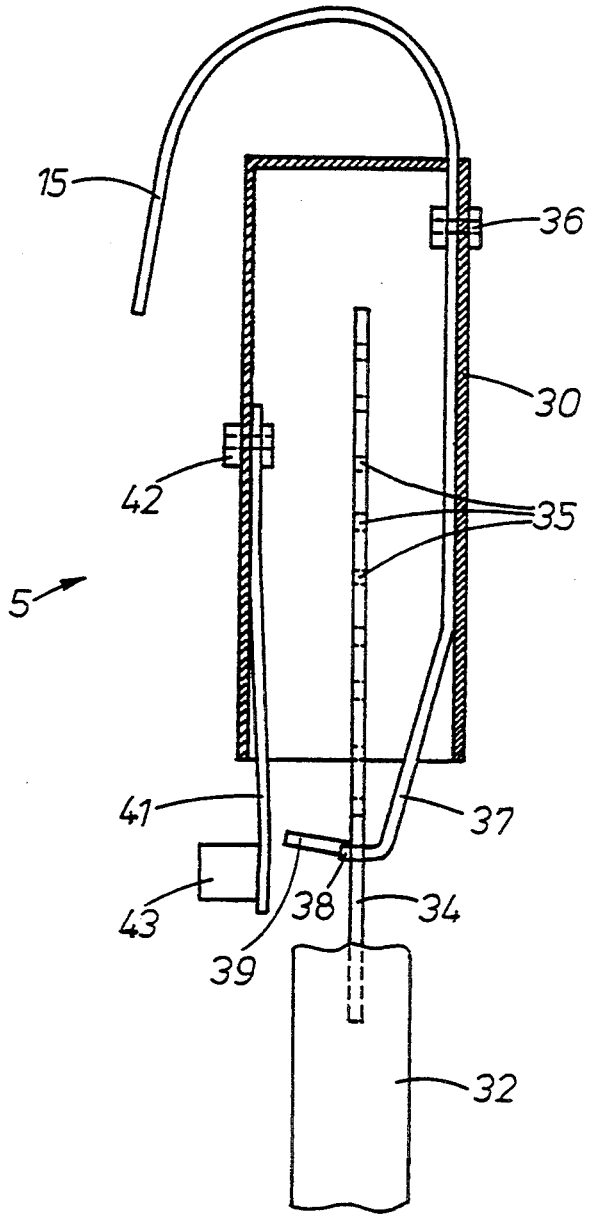
FIG. 3 shows a side view, on an enlarged scale and partly sectioned, of an adjustable holding means for assembly of the back on the back support.
Figure 4:
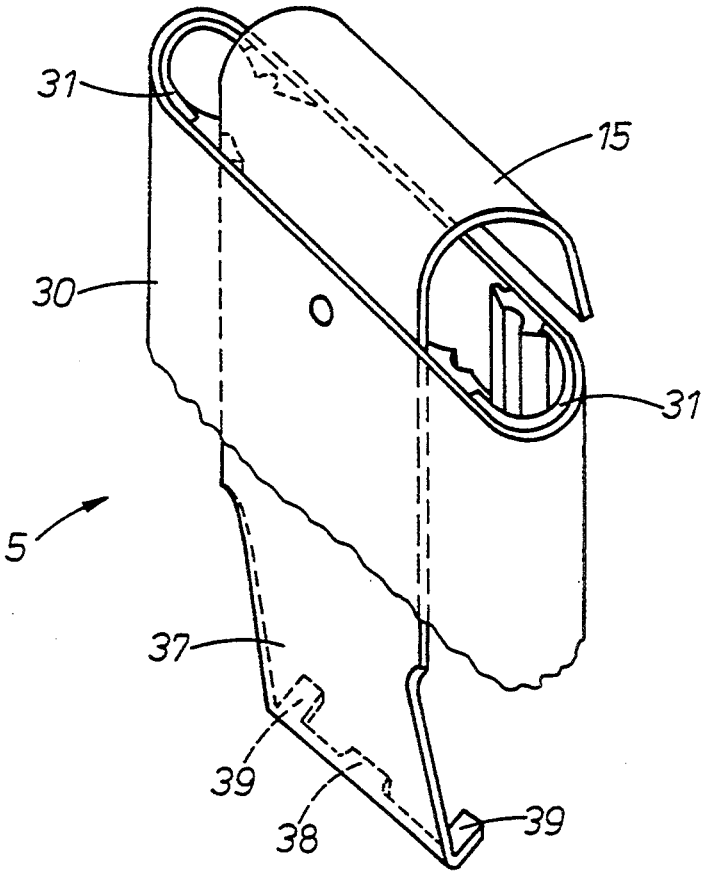
FIG. 4 shows a partial perspective view of the holding means in FIG. 3.

The back support 6 is connected to a lower carrier body 13 which is fixed to the mechanism 8 and comprises a back bow means 14 which, at its lower end, is adjustably connected to the carrier body, and at its upper end is connected to the holding means 5 which is further shown in FIGS. 3 and 4. The back 4 is fixed to a metal spring 15 forming part of the holding means 5. By means of the metal spring 15, the back can be moved by a sitting person in the shown direction A—A in that the person exerts a force on the back cushion 4. The back can also be moved in the direction B—B by pressure from the back of the sitting person. This results in a rotary motion of the back carrier about the axis of rotation 7 of the torsion mechanism.

The entire back unit 4, 6 can also be adjusted in the direction C—C, to thereby achieve the best sitting depth. The adjustment takes place by loosening the shown hand wheel 16 to thereafter pull the back unit outwards or inwards in the topical direction. When the correct placing of the back unit in relation to the seat has been achieved, the hand wheel 16 is locked.

A coupling means 20 is arranged between the seat 1 and the back support 6 for the provision of a synchronous movement of the seat 1 in relation to the back 4 when changing the relative position of these members. According to the invention the coupling means consists of a means having a length which can be readjusted with a certain inertia for adjustment of the relative position of the seat and the back support. This means may consist of e.g. a suitable mechanical coupling means. However, in the preferred embodiment it consists of a hydraulic cylinder (oil cylinder) which, at its ends, is rotatably connected to the back support 6 at a fulcrum 21, and to the seat 1 at a fulcrum 22.

The oil cylinder 20 may e.g. offer a linear resistance of ca. 150N against forward tilting of the seat, and a resistance of ca. 900N when being returned. This results in that the seat can be tilted reasonably quickly to full forward tilting. The return towards the "normal position" is slower and is felt natural and comfortable. The distances between the bearing points of the cylinder and the axes of rotation of the seat and the back support, respectively, will be decisive for the chosen cylinder resistance and stroke. Similarly, the working angle of the cylinder will be of importance for the resistance characteristic.

The seat it tilted or rotated the necessary or desired number of degrees about the axis of rotation 2 in that the sitting person makes use of the body weight. Thus, by placing the weight on the forward portion of the seat, the front edge will go down and the rear edge up. The oil cylinder sees to it that the motion becomes linear and comfortable.

This structure involves that the angular adjustment of the seat is independent of the other adjustment means of the chair. The advantage is that the seat and back can be moved together at a desired stroke, or in the way desired by the sitting person.

The operation of the oil cylinder is as follows: When the piston rod of the cylinder is pulled in an outwards direction (with the necessary force, e.g. 150N), the oil flows through a disk-shaped piston provided with a usual annular piston packing, and with a number of circularly disposed through holes. The oil flow through the holes is prevented at the rear side of a planar disk-shaped valve plate which normally seals the holes. This flexes outwards to a saucer shape due to pressure exerted by the oil, and lets out the oil along the periphery. The rigidity of the valve plate, or possibly the number thereof, will be able to determine the force required to pull out the piston rod. When the piston rod is pushed in, another corresponding valve plate or plates on the other side of the piston will obstruct the oil flow in a corresponding manner, with for example a desired necessary displacement force of 900N. The oil flow for outgoing and ingoing piston movement, respectively, passes in a respective set of holes. The oil cylinder is a commercially available standard part which is delivered in finished form from the supplier, with the desired displacement force/resistance, for example the mentioned 150/900N.

Figure 2:
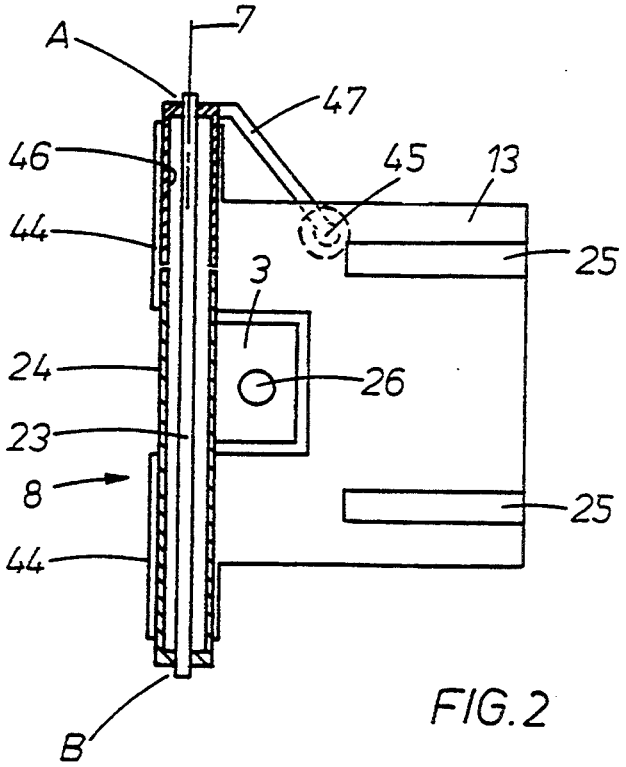
FIG. 2 shows a top view of a turning mechanism and a carrier body for the back support of the chair.

The torsion spring and turning mechanism 8 of the chair is shown more in detail in FIG. 2 as viewed from above. The mechanism comprises a transversely extending through-going torsion or rod spring 23 projecting on both sides of the frame or bracket 3 and being fixed at the respective points A, B. The fastening point B is fixedly connected to a tubular spring housing 24 surrounding $\frac{3}{4}$ of the length of the spring. This spring housing 24 is attached asymmetrically to the bracket 3. Symmetrically to the bracket 3, the spring housing 24 is surrounded by a pair of tubular bearing sleeves 44 which are both fixed to the carrier body 13. The other fixing point A of the spring is connected to a short bearing sleeve 46, preferably with the same diameter as the spring housing 24, to which there is fixed a transfer arm 47 transferring the torsion-spring force to the carrier body 13, through an adjustable means 45 for adjusting the spring tension. The carrier body 13 further is provided with a pair of grooves 25 at the rear edge for receiving respective bow tubes 32 (see FIGS. 3 and 5) forming the back bow means 14. As shown, the bracket 3 has a hole 26 for receiving the end of the gas column 9.

When the back support 6 is subjected to a load and presses the carrier body 13 downwards, the force at the point A will twist the spring 23, the point turning about the spring axis together with the body 13, at the same time as the spring is retained at the point B. Consequently, the torsion spring provides a counter force balancing said load. The torsional force or counter force can be adjusted by means of tensioning (or twisting) of the spring 23, for adaptation to the weight of the person sitting in the chair. The adjustment takes place by means of the adjustment means 45, wherein the preload between the spring 23 and the back of the chair can be adjusted.

The holding means for adjusting the height of the back 4 in relation to the seat 1 is shown more in detail in FIGS. 3 and 4.

The means comprises a housing 30 in the form of an especially shaped aluminium profile. The profile, which is shown in schematic longitudinal section in FIG. 3 and in partial perspective view in FIG. 4, is cylindrical and has an oval cross-section, and in the spaces along the opposite rounded inner sides of the profile there are pressed in plastic guides 31 having a partially circular cross-section, for easily slidable but play-free receipt of the two bow tubes 32 of the back support 6, of which tubes only a section of one bow tube is shown in FIG. 3.

Figure 5:
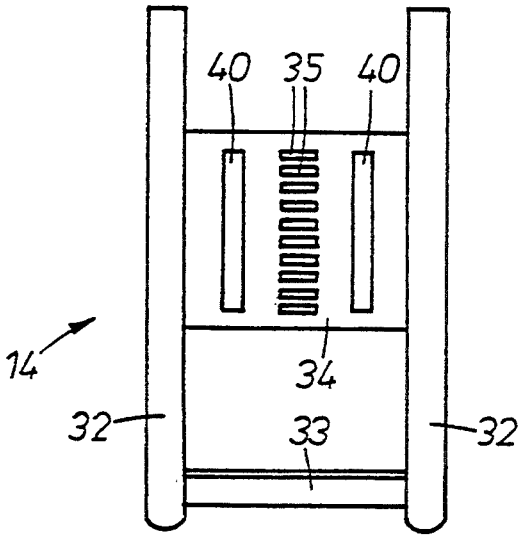
FIG. 5 shows a view of the back support as viewed from behind.

As appears from FIG. 5, a stiffener plate 33 and an adjustment plate 34 are welded between the back bow tubes 32. In its central area the adjustment plate 34 is provided with a number of mutually spaced rectangular holes 35. The aforementioned metal spring 15 is fixed in grooves on the profile 30, and in addition is secured by screws to the profile, as shown at 36 in FIG. 3. At its lower and the metal spring has a plate portion 37 having an angularly bent end part which firstly is formed with a central tongue 38 for engagement in a chosen one of the rectangular holes 35 in the adjustment plate 34, and secondly, at its end edges on each side of the tongue 38, is provided with pair of release tongues or projections 39 projecting through and being slidable in respective guide grooves 40 extending in parallel along the side edges of the adjustment plate 34. By pressure actuation of at least one of the projections 39 in the direction of the plate 34, the spring tongue 38 may be disengaged from the current hole 35 in the plate. For this purpose a resilient plate 41 is fixed to the aluminium profile 30 as shown at 42, and at its free end is provided with an operating member 43 for pressing the release projections 39.

When the adjustment plate 34 is moved upwards into the profile or housing 30, the tongue 38 of the spring plate will snap into the uppermost one of the rectangular holes 35 in the plate. By pushing the projections 39 inwards, the tongue will be pushed out from said hole, so that the plate 34 and the back bow tubes 32 may be moved until the tongue snaps into a desired hole in the plate.

By means of this arrangement the chair back 4 may be adjusted up or down by pressing the operating member 43. This is done in that the person sitting on the chair takes his hands behind his back, presses the operating member 43 and pulls the chair back up or down as desired until the best position is obtained (loins adaptation). The holes 35 are so closely spaced that one easily finds the desired height of the chair back.

As mentioned above, the chair according to the invention has two independent, possible movements of the back, of which one movement is obtained by means of the spring 15 and the other by means of the torsion turning mechanism 8. Both of these movements are linear, without jerking, and therefore comfortable. The weight of the person sitting on the chair is decisive for the adjustment of the counter force of the torsion spring. As mentioned, the adjustment takes place by twisting of the rod spring.

The seat mounting and the back mounting have the effect that the variable sitting angle will be able to be adjusted according to the will of the user. Further, by means of the special coupling means according to the invention, there is obtained a separate, simple and easy angular adjustment of the seat forwards, and all in all there is obtained a chair having a self-adjusting and self-adapting sitting angle. Any person using the chair may quickly find his ideal sitting posture without this becoming statical and loading.

I claim:

1. A chair, especially a working/office chair, comprising a seat supporting frame, a seat rotatably mounted in the frame about a first axis, a back support rotatably mounted in the frame about a second axis behind said first axis, and a coupling means forming a length-adjustable connection between the seat and the back support behind said axes for maintaining a substantially constant length and causing synchronous movement of the seat in relation to the back support when tilting the chair, said coupling means comprising a hydraulic cylinder having a length which can be readjusted with a predetermined force for stepless adjustment of relative positions of the seat and the back support independently of said synchronous movement, so that the position of the seat relative to the back can be readjusted by exertion of a torque on the seat about said first axis while the back support simultaneously is kept essentially stationary relative to said frame.

2. A chair according to claim 1, wherein said first axis of rotation of the seat is displaced forwards from a middle of the seat, and wherein said hydraulic cylinder is constructed so that it requires a smaller force to be extended than to be shortened.

3. A chair according to claim 1, wherein said back support is horizontally displaceably mounted in said frame, to enable horizontal displacement of the back of the chair in a forward or rearward direction relative to the seat, for achieving a desired sitting depth.

4. A chair according to any of claims 1, 2, or 3, wherein the chair back is connected to the back support through a holding means enabling height adjustment of the back in relation to the back support.

5. A chair according to claim 4, wherein said holding means comprises an adjustment plate attached to the back support and provided with a number of vertically spaced holes and wherein the back is attached to a resilient plate having a tongue arranged for engagement with an arbitrary one of said holes, there being provided a manually operable means to move said tongue out of locking engagement with said hole.

* * * * *